US008491406B2

(12) United States Patent
Bone

(10) Patent No.: US 8,491,406 B2
(45) Date of Patent: Jul. 23, 2013

(54) PERFORMANCE ENHANCED GOLF CLUB SHAFTS

(75) Inventor: Donald S. Bone, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 217 days.

(21) Appl. No.: 12/644,055

(22) Filed: Dec. 22, 2009

(65) Prior Publication Data

US 2011/0151988 A1 Jun. 23, 2011

(51) Int. Cl.
*A63B 53/10* (2006.01)

(52) U.S. Cl.
USPC ..... 473/289

(58) Field of Classification Search
USPC ..... 473/289
See application file for complete search history.

(56) References Cited

U.S. PATENT DOCUMENTS

| | | | | |
|---|---|---|---|---|
| 3,998,458 | A | 12/1976 | Inoue et al. | |
| 4,023,801 | A | 5/1977 | VanAuken | |
| 4,157,181 | A * | 6/1979 | Cecka | 473/319 |
| 5,040,279 | A * | 8/1991 | Braly | 29/407.07 |
| 5,879,241 | A * | 3/1999 | Cook et al. | 473/289 |
| 5,904,627 | A | 5/1999 | Miyaji et al. | |
| 5,924,936 | A | 7/1999 | Penley | |
| 5,944,616 | A * | 8/1999 | Horwood et al. | 473/289 |
| 6,117,021 | A | 9/2000 | Crow et al. | |
| 6,719,648 | B1 | 4/2004 | Smith | |
| 6,863,623 | B2 | 3/2005 | Oyama | |
| 7,169,056 | B2 | 1/2007 | Shiraishi et al. | |
| 7,338,386 | B2 | 3/2008 | Nakajima | |
| 2005/0217379 | A1 * | 10/2005 | Weiss et al. | 73/579 |
| 2010/0041492 | A1 * | 2/2010 | Rice et al. | 473/289 |
| 2010/0317457 | A1 * | 12/2010 | Hulock et al. | 473/320 |

* cited by examiner

*Primary Examiner* — Stephen L. Blau
(74) *Attorney, Agent, or Firm* — Randy K. Chang

(57) ABSTRACT

A plurality of two or more golf club shafts designed to optimize the performance of a specific shaft with respect to a specific golf swing is disclosed herein. More specifically, the present invention discloses a plurality of two or more golf club shafts wherein a dramatic difference in torque can be achieved by two golf club shafts within the same weight classification regardless of the flex of the shaft. A plurality of golf club shafts in accordance with the present invention may generally a difference in weight-to-torque ratio of greater than about 1.5 and a difference in butt-frequency-to-torque ratio of greater than about 8.0 between any two golf club shafts within the plurality of golf club shafts.

3 Claims, 7 Drawing Sheets

PERFORMANCE ENHANCED GOLF CLUB SHAFTS

FIELD OF THE INVENTION

The present invention relates generally to a plurality of two or more golf club shafts designed in a matrix to optimize the performance of a specific shaft with respect to a specific golf swing. More specifically, the present invention relates to a plurality of two or more golf club shafts wherein the change in torque between one club and another is significantly larger. Even more specifically, the present invention relates to a plurality of two or more golf club shafts wherein the change in weight-to-torque ratio between any two shafts within the plurality is greater than about 1.5 and a change in butt-frequency-to-torque ratio is greater than about 8.0

BACKGROUND OF THE INVENTION

The equipment used to play the game of golf has always played a significant role within the game of golf itself. Various equipment ranging from golf clubs, golf balls, golf shoes, to even golf gloves have all been used by golfers who play the game of golf. Because golf equipment is so closely related to technological advancements, the development of technology within the golf industry has changed the way the game has matured throughout the years.

Of all the various types of golf equipment that have evolved throughout the years, the development of golf clubs has made the most dramatic strides, making the game of golf more enjoyable for the average golfer. For example driver type golf club heads originally started with persimmon woods clubs woods have completely morphed into gigantic hollow titanium clubs with volumes greater than 400 cubic centimeters (cc). Iron type golf club heads have also evolved from solid iron type golf club heads to ones that now have a hollow cavity in the back of the allowing the golfer to hit the golf ball straighter and more consistently. Even putter type golf club heads have developed to have more heel toe weighting with interchangeable weights at the toe and heel to provide for more adjustable forgiveness on off center putts.

Even on a more macro level of individual golf clubs, different technological advancements have helped to improve the performance of golf club components such as the golf club head, golf club grip, and the golf club shaft. For example, U.S. Pat. No. 5,904,627 to Miyaji et al. ('627 patent) discusses a golf club shaft that comprises of three interconnected tubular members whose diameters, flexional rigidities, lengths, materials, etc. are selected to make the golf club shaft more flexible near the club head or the club grip or at the middle portion to improve performance. U.S. Pat. No. 7,338,386 to Nakajima ('386 patent) discloses another improvement to the performance of the shaft of a golf club by discussing a light-weighted golf club shaft, which can stabilize the swing orbit of a golf club head during a swing and can allow a player to swing a golf club easily and to have a consistent shot pattern by having a length of 42 to 48 inches, a weight of 35 to 50 grams, a center of gravity located within 46% to 49% of its entire length from its tip and a torque to the tip-end of the shaft ranges between 3.0 and 4.5.

Despite the above technological advancements within golf club shafts, golf club shafts have generally been designed in a vacuum, only paying attention to the design spaces available within an individual golf club, without considering performance benefits that can be achieved by looking at new design spaces available across different clubs with different shafts. Although maximizing the performance of an individual shaft within an individual golf club may help with the performance of that specific golf club, the game of golf requires the use of many different golf clubs, each club with its own shaft requiring individualized analysis. U.S. Pat. No. 6,117,021 to Crow et al. addresses this issue by disclosing a set of golf clubs comprising a plurality of shafts that decreases in length along the set. Each shaft includes a reverse taper section disposed a distance from the tip section on each shaft and the distance of the reverse taper section varies along a number of shafts as the shaft length decreases.

However, in view of all the technological advancements in the field of golf club shafts, one of the most uncontrollable variables to the performance of a golf club shaft is the actual golf swing itself. If every golfer had the same swing parameters, designing a golf club shaft to optimize the performance of a golf shot would be significantly easier. Consequently, because of the dramatic variations among golfer's swings, the optimal performing shaft for an individual golfer may need to be individually determined based on the golfer and his or her golf swing. U.S. Pat. No. 6,719,648 to Smith ('648 patent) explores this concept by disclosing a method and a system for precisely fitting a golfer to a selected stiffness of a golf shaft and to a selected flex choice of a golf shaft. More specifically, the '648 patent discloses a method and means for precisely fitting a golfer to a particular golf shaft whose values of stiffness and flex choice are applicable to a player of a specific skill level in the game of golf.

Ultimately, even if a golfer finds the correct shaft flex and stiffness for every one of his golf clubs, he would have to search through different shaft models from different manufacturers, with different weights, different flex determinants, different torque values, different tip frequencies, different butt frequencies, and different feel to ensure he or she optimizes the performance potential of his or her golf swing for different golf clubs within his arsenal. More often than not, different shafts capable of achieving one of the performance criteria desirable for a specific golfer will not be able to provide a correct match with other performance criteria; causing the golfer to make a sacrifice.

Hence, it can be seen from above that there is a need in the field for a plurality of shafts created within a matrix from which a golfer can select to maximize the performance characteristics of his or her golf swing without having to sacrifice other criteria that he or she may desire to keep consistent. More specifically, there is a need in the field for a plurality of two or more golf club shafts wherein the golfer may select to adjust only the performance criteria that he or she desires to change, while keeping other performance criteria consistent regardless of which selection he chooses.

BRIEF SUMMARY OF THE INVENTION

One aspect of the present invention is a plurality of two or more shafts for a golf club comprising a first shaft and a second shaft. The first shaft may be substantially tubular in shape with a first shaft weight, a first shaft flex, a first shaft torque, a first tip frequency, and a first butt frequency. The second shaft may also be substantially tubular in shape with a second shaft weight, a second shaft flex, a second shaft torque, a second tip frequency, and a second butt frequency. The first shaft and the second shaft selected from the plurality of two or more shafts are substantially equal in weight and have a change weight-to-torque ratio between the first shaft and the second shaft of greater than about 1.5. The weight-to-torque ratio of a shaft is determined by dividing the weight of the shaft by the torque of the shaft.

In another aspect of the present invention is a plurality of golf club shafts comprising a first shaft and a second shaft. The first shaft may be substantially tubular in shape with a first shaft weight, a first shaft flex, a first shaft torque, a first tip frequency, and a first butt frequency. The second shaft may also be substantially tubular in shape with a second shaft weight, a second shaft flex, a second shaft torque, a second tip frequency, and a second butt frequency. The difference in butt-frequency-to-torque ratio between the first shaft and the second shaft is greater than about 8.0, wherein the butt-frequency-to-torque ratio is determined by dividing the butt frequency by the torque of the shaft. The first shaft and the second shaft within the plurality of golf club shafts may have substantially identical graphics.

In a further aspect of the present invention is a method of providing a plurality of golf club shafts to be used with a golf club head comprising the steps of providing a plurality of different weight classifications within the plurality of golf club shafts, providing a plurality of different flex classifications within the plurality of golf club shafts, and providing a plurality of different launch conditions within the plurality of golf club shafts. The difference in weight-to-torque ratio between any two shafts within the plurality of golf club shafts is greater than about 1.5, wherein the weight-to-torque ratio is determined by dividing the weight of the shaft by the torque of the shaft.

These and other features, aspects, and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

Figure 1:
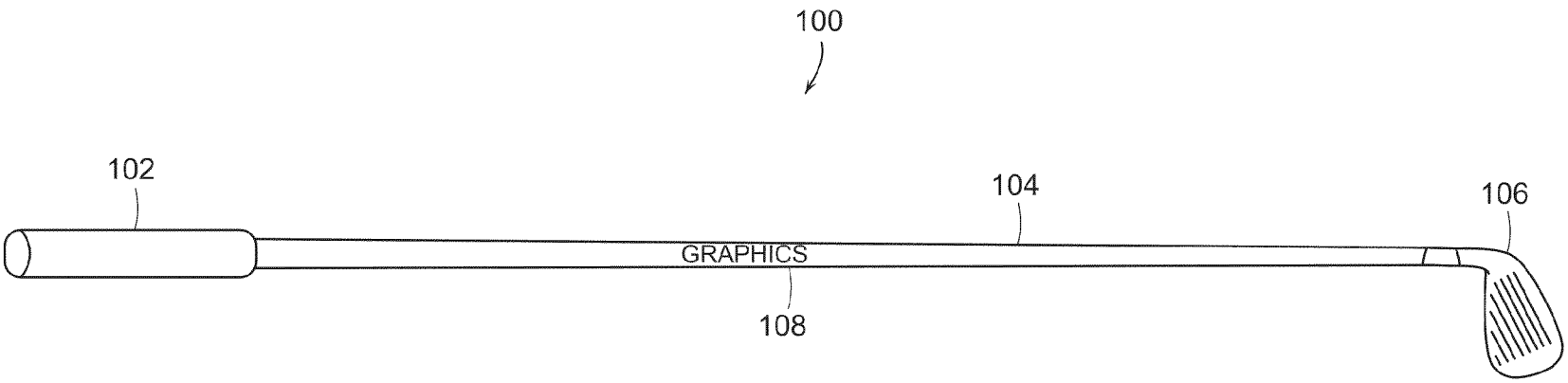
FIG. 1 is a perspective view of a golf club shaft in accordance with an exemplary embodiment of the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

TABLE 1

| | Weight < 60 g | | | | Weight = mid 60 g | | | | Weight > 70 g | | |
|---|---|---|---|---|---|---|---|---|---|---|---|
| High Launch Flex | X | S | R | A | X | S | R | A | X | S | R |
| Weight | 59 g | 58 g | 57 g | 56 g | 65 g | 64 g | 63 g | 62 g | 73 g | 72 g | 71 g |
| Torque | 4.5° | 5.5° | 6.5° | 6.5° | 3.9° | 5.0° | 6.0° | 6.0° | 3.3° | 4.0° | 5.0° |
| Tip Frequency | 850 cpm | 800 cpm | 750 cpm | 700 cpm | 860 cpm | 810 cpm | 760 cpm | 710 cpm | 870 cpm | 820 cpm | 770 cpm |
| Butt Frequency | 270 cpm | 255 cpm | 240 cpm | 225 cpm | 275 cpm | 260 cpm | 245 cpm | 230 cpm | 280 cpm | 265 cpm | 250 cpm |
| Mid Launch Flex | X | S | R | | X | S | R | | X | S | R |
| Weight | 59 g | 58 g | 57 g | | 65 g | 64 g | 63 g | | 73 g | 72 g | 71 g |
| Torque | 4.5° | 5.5° | 6.5° | | 3.9° | 5.0° | 6.0° | | 3.3° | 4.0° | 5.0° |
| Tip Frequency | 880 cpm | 830 cpm | 780 cpm | | 890 cpm | 840 cpm | 790 cpm | | 900 cpm | 850 cpm | 800 cpm |
| Butt Frequency | 270 cpm | 255 cpm | 240 cpm | | 275 cpm | 260 cpm | 245 cpm | | 280 cpm | 265 cpm | 250 cpm |
| Low Launch Flex | X | S | R | | X | S | R | | X | S | R |
| Weight | 59 g | 58 g | 57 g | | 65 g | 64 g | 63 g | | 73 g | 72 g | 71 g |
| Torque | 4.5° | 5.5° | 6.5° | | 3.9° | 5.0° | 6.0° | | 3.3° | 4.0° | 5.0° |
| Tip Frequency | 910 cpm | 860 cpm | 810 cpm | | 920 cpm | 870 cpm | 820 cpm | | 930 cpm | 880 cpm | 830 cpm |
| Butt Frequency | 270 cpm | 255 cpm | 240 cpm | | 275 cpm | 260 cpm | 245 cpm | | 280 cpm | 265 cpm | 250 cpm |

Table 1 above shows a table of a matrix of shaft specifications within an offering that is designed to correctly provide the appropriate shaft for a particular golfer in accordance with the present invention. More specifically, as it can be seen from Table 1, the matrix of different shaft offering specifications provides a comprehensive coverage of different golf shafts with different performance criteria for different weight, different flex, and different launch conditions. Examining Table 1 more closely will yield four important performance criteria generally associated with the correct matching of a golfer with the appropriate shaft that fits his or her golf swing. Performance criteria such as the weight, torque, tip frequency, and butt frequency are generally used to determine the performance of a golf club shaft; however, numerous other factors not mentioned here, such as length of the golf club shaft or the internal geometry of the golf club shaft, may also be included in this current matrix without departing from the scope and content of the present invention.

It is important to initially recognize that golf club shafts included in this matrix of golf club shaft offerings are comprised of golf club shafts that will maintain the "feel" of such a golf club shaft. More specifically, golf club shafts included in this matrix may generally have different performance criteria such as the weight, torque, flex, tip frequency, and butt frequency of these shafts all while maintaining the same feel within all golf club shafts within the matrix. This concept of maintaining consistency in the feel of the golf club shaft is important because golfers often prefer the feel of a certain type of shaft, but that type of shaft may not offer the correct performance criteria to compliment his swing type. Although somewhat intangible, the "feel" of a golf club shaft is nonetheless a discernable characteristic of a golf club shaft that could affect the decision of a golfer to select a golf club shaft. This "feel" of a golf club shaft can have an effect on the performance of a golf club shaft, and could even play a very significant role in the playability and commercial acceptance of a particular golf club shaft.

Although numerous golf club shafts exist out there with various performance criteria, such as weight, torque, flex, tip frequency, and butt frequency, none of these golf club shafts act and perform in unison as a plurality of shaft offerings to provide the same performance in terms of "feel", composition, and even manufacturing technique independent of the performance criteria a particular golfer desires. It should be noted that this plurality of shaft offerings that provide the same performance criteria may even extend over the plurality of golf clubs from a driver type golf club to a wedge type golf club without departing from the scope and content of the present invention.

FIG. 1 shows a perspective view of a golf club head 100 with a grip 102, a shaft 104, and a golf club head 106. The golf club shaft 104, shown here in accordance with an exemplary embodiment of the present invention, may generally have graphics 108 that are identical throughout the entire plurality of golf club shafts 104. This uniformity in the graphics 108 may generally help convey that all golf club shafts 104 within the matrix of a plurality of golf club shafts 104 will have uniformity in feel irrespective of the different performance criteria that provide a golfer with different shaft performance outcomes associated with the golf club shaft 104. The golf club shaft is capable of achieving this uniformity by ensuring that the graphics 108, the material, the manufacturing technique, as well as the feel of the golf club shaft 104 are consistent regardless of which golf club shaft is selected with the desired performance criteria. This methodology of creating such a matrix of golf club shafts 104 allows a golfer to determine and adjust the performance criteria of his golf club shaft 104 by only adjusting the meaningful performance criteria that affect the desirable outcomes while keeping other factors constant.

The shaft graphics 108 referred to above are not limited to the specific characters of g, r, a, p, h, i, c, and s, but relate generally to any sort of visual illustrations capable of creating a mark on the shaft 104 without departing from the scope and content of the present invention. More specifically, graphics, as referred to in FIG. 1, could refer to a company logo, a company name, a product logo, a product name, a graphical display, an alignment arrow, an alignment mark, an alignment dot, an alignment line, any types of characters, numbers, or any visual illustration capable of providing visual feedback indicating that all shafts 104 belong to the same matrix of shafts without departing from the scope and content of the present invention. Graphics 108, on the other hand, may generally not include specific model numbers, specific serial numbers, specific weight classification, specific flex classifications, or any other graphical values that are indicative of the performance criteria of the golf club shaft 104.

Returning to Table 1 showing the matrix of shaft specifications in accordance with an exemplary embodiment of the present invention, we can see that despite the fact that all the golf club shafts belong in the same matrix with the same feel, the various golf club shafts within the matrix may have different performance criteria to accommodate golfers with different swing types. More specifically, the matrix of one or more golf club shafts within the plurality may generally have a change in weight-to-torque ratio between a first golf club shaft and a second golf club shaft of greater than about 1.5, more preferably greater than about 2.0, and most preferably greater than about 2.5. The first golf club shaft and a second golf club shaft within the matrix may generally have a different flex, thus the weight-to-torque ratio change that is referred to above spans across golf club shafts of different flexes. The weight-to-torque ratio, as referred to in this current application, may generally be defined as the weight of the golf club shaft divided by the torque of the golf club shaft; more accurately described by Equation 1 below.

$$\text{Weight-to-Torque Ratio} = \frac{\text{Weight of Shaft}}{\text{Torque of Shaft}} \qquad \text{Eq. (1)}$$

One of the most important factors in determining the weight-to-torque ratio above is the weight of the golf club shaft, which can vary depending on the desired performance criteria. More specifically, referring back to Table 1, a golf club shaft with a weight in the less than 60 gram classification may generally have an R-flex shaft with a weight of about 57 grams, an S-flex shaft with a weight of about 58 grams, and an X-flex shaft with a weight of about 59 grams. In another example, a golf club shaft with a weight in the mid 60 gram classification may generally have an R-flex shaft with a weight of about 63 grams, an S-flex shaft with a weight of about 64 grams, and an X-flex shaft with a weight of about 65 grams. Finally, a golf club shaft with a relatively heavier weight classification in the low 70 gram range may include an R-flex shaft with a weight of about 71 gram, an S-flex shaft with a weight of about 72 grams, and an X-flex shaft with a weight of about 73 grams.

Various factors can affect the change of torque within a golf club shaft in accordance with the present invention. In one exemplary embodiment of the present invention, the golf club shaft may have fibers that are arranged in a pre-determined angle of orientation to provide the change in torque of a golf club shaft. In an alternative embodiment of the present invention, a golf club shaft may be made out of filament reinforced resin that are wound at different winding angles to change the torque of the golf club shaft. More information regarding the specifics of changing the torque of the golf club shaft can be found in U.S. Pat. Nos. 3,998,458 and 4,023,801, the disclosures of which are incorporated by reference herein in its entirety.

In addition to the weight differences identified above, the plurality of golf club shafts included in the matrix may generally have a significant torque change between the different flexes that are within the same weight classification. For example, a golf club shaft with a weight in the less than 60 gram classification may generally have an R-flex shaft with a torque of about 6.5°, an S-flex shaft with a torque of about 5.5°, and an X-flex shaft with a torque of about 4.5°. In another example, a golf club shaft with a weight in the mid 60 gram classification may generally have a R-flex shaft with a torque of about 6.0°, a S-flex shaft with a torque of about 5.0°, and an X-flex shaft with a torque of about 3.9°. In a final example of a golf club shaft with a relatively heavier weight classification in the mid 70 gram range, an R-flex shaft may have a torque of about 5.5°, an S-flex shaft may have a torque of about 4.5°, and an X-flex shaft may have a torque of about 3.3°. It is worth noting in this exemplary embodiment that the change in torque of a golf club shaft within this plurality may generally be greater than what is normally available in a plurality of golf club shafts, yielding the weight-to-torque ratio mentioned above in Equation 1.

As the torque numbers above show, the difference in torque between any two golf club shafts within the matrix is greater than about 1.18; given that the two golf club shafts have different flexes. More specifically, looking at an S-flex shaft and an R-flex shaft within the light weight classification of less than 60 grams, we can see that the R-flex shaft may generally have a torque of about 6.5° while the S-Flex shaft may generally have a torque of about 5.5°. Because the torque in the R-flex shaft may generally be greater than about 1.18 times the torque of the shaft in the S-flex, it can be said that the first shaft torque is at least about 1.18 times of the second shaft torque, provided that the first shaft does not have the same flex as the second shaft.

Closer examination of Table 1 showing the matrix of shaft may also yield a different ratio that could be of interest. More specifically, Table 1 also shows that a ratio could be established between the butt frequency and the torque of a golf club shaft. This butt-frequency-to-torque ratio of the golf club shaft may be of interest to the performance of the golf club shaft because the butt frequency of a golf club may generally relate to the flex of a golf club shaft, which happens to be one of the performance criteria. The matrix of one or more golf club shafts within the plurality may generally have a change in butt-frequency-to-torque ratio between a first golf club shaft and a second golf club shaft greater than about 8.0, more preferably greater than about 9.0, and most preferably greater than about 10.0. The first golf club shaft and a second golf club shaft within the matrix may generally have a different flex, thus the butt-frequency-to-torque ratio change that is referred to above spans across golf club shafts with different flexes. The Butt-Frequency-to-Torque Ratio, as referred to in this current application, may generally be defined as the butt frequency of the golf club shaft divided by the torque of the golf club shaft; more accurately described by Equation 2 below.

$$\text{Butt-Frequency-to-Torque Ratio} = \frac{\text{Butt Frequency}}{\text{Torque}} \qquad \text{Eq. (2)}$$

In addition to the dramatic torque change between the different golf club shafts within the matrix there is also significant butt frequency differences between the different golf club shafts. For example, a golf club shaft with a weight in the less than 60 gram classification may generally have an R-flex shaft with a butt frequency of about 240 cpm (cycles per minute), an S-flex shaft with a butt frequency of about 255 cpm, and an X-flex shaft with a butt frequency of about 270 cpm. In another example, a golf club shaft with a weight in the mid 60 gram classification may generally have a R-flex shaft with a butt frequency of about 245 cpm, a S-flex shaft with a butt frequency of about 260 cpm, and an X-flex shaft with a butt frequency of about 275 cpm. In a final example, a golf club shaft with a relatively heavier weight classification in the low 70 gram may have a R-flex shaft with a butt frequency of about 250 cpm, an S-flex shaft with a butt frequency of about 265 cpm, and an X-flex shaft with a butt frequency of about 280 cpm. It is worth noting that in this exemplary embodiment the change in torque of a golf club shaft within the matrix of a plurality of golf club shaft may be greater than what is normally available in a plurality of golf club shafts, yielding the butt-frequency-to-torque ratio mentioned above in Equation 2.

Finally, Table 1 also shows the specific tip frequency of the specific shafts within the matrix of the plurality of golf club heads. Because the tip frequency of a golf club shaft may generally relate to the launch conditions of a golf club head, the tip frequency of a golf club shaft in accordance with the present invention may provide a range of different numbers to accommodate for the different launch conditions. More specifically, a golf club shaft with a weight in the less than 60 gram classification may generally have an R-flex shaft with a tip frequency of between about 750 cpm to about 810 cpm, an S-flex shaft with a tip frequency of between about 800 cpm to about 860 cpm, and an X-flex shaft with a tip frequency of between about 850 cpm to about 910 cpm. In another example, a golf club shaft with a weight in the mid 60 gram classification may generally have a R-flex shaft with a tip frequency of between about 760 cpm to about 820 cpm, an S-flex shaft with a tip frequency of between about 810 cpm to about 870 cpm, and an X-flex with a tip frequency between about 860 cpm to about 920 cpm. In a final example, a golf club shaft with a relatively heavier weight classification in the low 70 gram may have a R-flex shaft with a tip frequency of about 770 cpm to about 830 cpm, an S-flex shaft with a tip frequency of about 820 cpm to about 880 cpm, and an X-flex shaft with a tip frequency of about 870 cpm to about 930 cpm.

The offering of different variations in tip frequency of a golf club shaft between a shaft having the same flex, same weight, same torque, and same butt frequency is also unique to the current plurality of golf club shafts within this matrix. For example, a matrix offering a plurality of two or more golf club shafts in accordance with the present invention may offer an X-flex shaft with a weight of about 59 grams, a torque of about 4.5°, a butt frequency of about 270 cpm, and a tip frequency of 850 cpm for an individual who desires a higher launch condition. Alternatively, the present invention may offer a golf club shaft with the same specifications of an X-flex shaft with a weight of about 59 grams, a torque of about 4.5°, a butt frequency of about 270 cpm, and a tip frequency of 880 cpm for an individual who desires a medium launch condition. Finally, the present invention may also offer a golf club shaft with the same specifications of an X-flex shaft with a weight of about 59 grams, a torque of about 4.5°, a butt frequency of about 270 cpm, and a tip frequency of 910 cpm for an individual who desires a lower launch condition.

It is important to note that the above mentioned ratios discussed in accordance with an exemplary embodiment of the present invention help define the significant performance criteria generally associated with such a matrix of a plurality of golf club shafts that are provided in an offering. These performance criteria are a significant improvement over the prior art golf club shafts that are not organized in such an evenly spaced manner to provide a golf club shaft that maximizes the performance potential for every single possible golf swing. Prior art golf club shafts provide very limited variables that can be adjusted, and finding a golf club shaft that meets one performance criteria will generally require a sacrifice in a different performance criteria that they do not wish to change. The variables that golfers do not wish to have changed within their golf club shaft may generally be the feel, the cosmetic graphics, and the brand of their golf club shaft. The performance criteria that golfers do wish to have changed to match up with their golf swing may generally include the flex, the weight, the torque, the tip frequency, and the butt frequency.

Figure 2:
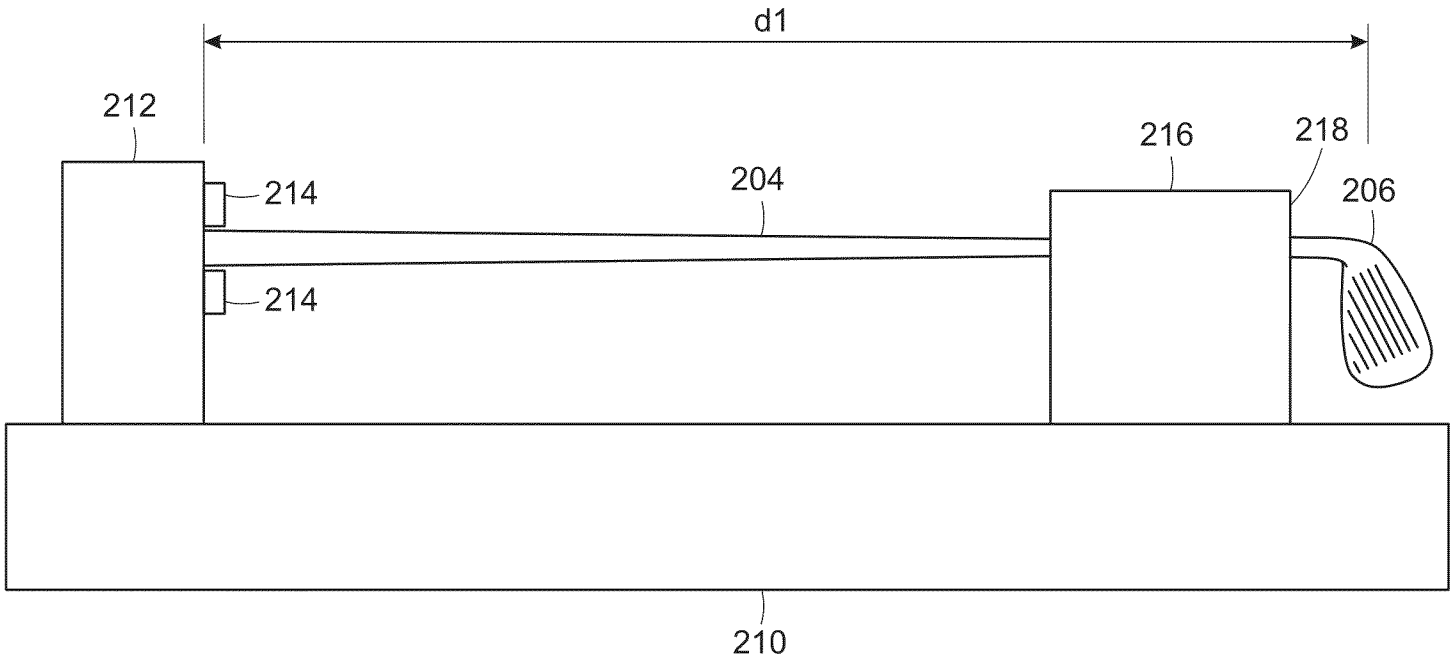
FIG. 2 is a side view of a measurement device used for measuring the frequency of a golf club shaft near the butt end in accordance with an exemplary embodiment of the present invention.

FIGS. 2-7 discuss in more detail how the various performance criteria are measured for golf club shafts within the plurality of matrix in accordance with an exemplary embodiment of the present invention. More specifically, FIG. 2 shows a side view of a device for measuring the frequency of a golf club shaft 204 in accordance with an exemplary embodiment of the present invention. Even more specifically, FIG. 2 shows a golf club shaft 204 connecting the butt end of the golf club shaft 204 to a clamping apparatus 212. FIG. 2 also shows a golf club shaft 204 attached to a golf club head 206, which serves as a weight to allow the golf club shaft 204 to oscillate. The golf club head 206, as used in this current exemplary embodiment, is a King Cobra Ti driver head with a weight of about 197 grams and a Center of Gravity (CG) location at about 0.66 inches further away from the tip of the shaft 204. Although the current exemplary embodiment utilizes a King Cobra Ti driver head 206, it should be appreciated that any golf club head may be used without departing from the scope and content of the present invention so long as it offers the same amount of weight and the same CG location as those provided by the numbers indicated above.

Once the golf club head 206 is attached to the golf club shaft 204, the butt end of the golf club shaft 204 may be inserted into a chuck 214 that will clamp down on the golf club shaft 204 to provide a pivoting point of the oscillation of the golf club shaft 204. Chuck 214, as shown in this current exemplary embodiment may generally be a six jaw chuck 214 to ensure proper clamping of the golf club shaft 204; however numerous other types of chucks 214 may be used that could include a two jaw chuck, a three jaw chuck, a four jaw chuck, or even an eight jaw chuck all without departing from the scope and content of the present invention. It should be noted that in order to determine the butt stiffness of a golf club shaft 204, the golf club shaft 204 is tightened into the chuck 214 at a distance d1 that is about 40¼ inches away from the tip end of the shaft to ensure proper results.

Subsequent to tightening the shaft 204 into the chuck 214, it is important to properly place the frequency measuring device 216 at the proper location along the length of the golf club shaft 204. FIG. 2 shows the frequency measuring device 216 being placed near the tip end of the golf club shaft 204 allowing it to capture the oscillation frequencies of the golf club shaft 204 across the entire length of the golf club shaft 204. More specifically, it may generally be desirable to align the hosel of the golf club head 206 close to or along the terminal end 218 of the frequency measuring device 216 to ensure proper measurement. It may be worthwhile to note here that the frequency measuring device used in accordance with the current exemplary embodiment of the present invention may be a Brunswick Golf frequency analyzer; however, other types of golf club shaft frequency analyzer may be used to measure the frequencies of the golf club shaft 204 so long as it is capable of determining the oscillation of the golf club shaft 204 in the unit of cycles per minute without departing from the scope and content of the present invention.

Figure 3:
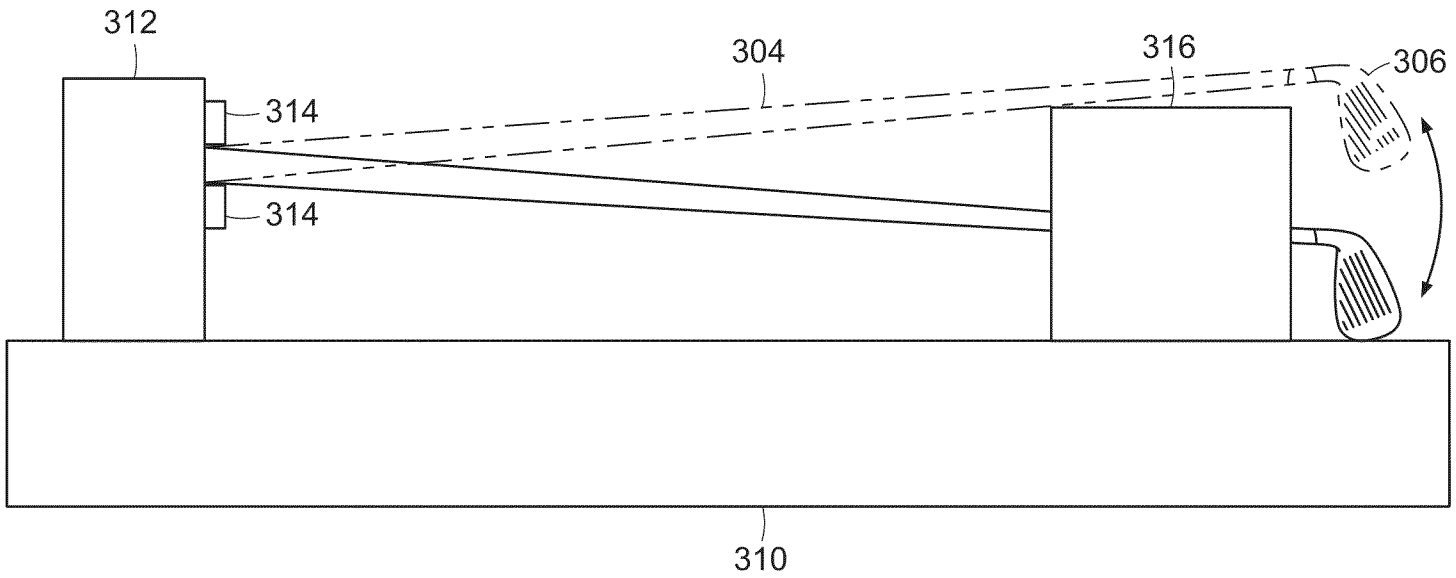
FIG. 3 is a side view of a golf club shaft under oscillation within a measurement device used for measuring the frequency of a golf club shaft in accordance with an exemplary embodiment of the present invention.

Once the golf club shaft 204 is securely tightened into the chuck 214 and the frequency measuring device 216 is properly placed at a correct distance for such a measurement, the apparatus may be ready for measuring the frequency of the golf club shaft 204. FIG. 3 shows the oscillation of the golf club shaft 304 secured at the butt end of the golf club shaft 304 utilizing a chuck 314 to secure the golf club shaft 304 to the clamping apparatus 312. In order to initiate the oscillation of the golf club shaft 304, it may be desirable to deflect the shaft 304 in a downward fashion until the golf club head 306 touches the base 310 of the entire measurement apparatus. Upon the release of the golf club head 306 from the base, the frequency measuring device 316 will determine a butt frequency of the golf club shaft 304 by determining the number of oscillations within a given time period. This frequency measured by the frequency measuring device 316 may generally be referred to as the un-normalized butt frequency of the golf club shaft 304.

The frequency measurement taken from the golf club shaft 304 in FIG. 3 may generally be referred to as an un-normalized butt frequency because it does not take in consideration that most golf club shafts 304 may come in different lengths from being cut down from a factory standard to fit the individual swing characteristics of the different golfers. In order to take in consideration of the fact that different length of different golf club shafts 304 could yield different frequency results, it may be desirable to normalize the raw data obtained from the steps described above with a base club length and a base swing weight. In order to achieve this, the current methodology normalizes the raw data to be consistent with a standard golf club shaft of about 45 inches long with a swing weight of C8.

In order to normalize the un-normalized raw data of butt frequency of the golf club shaft 304 described above in FIG. 3, it may be necessary to first determine the swing weight of the shaft 304 with the head 306 attached. Once the swing weight of the shaft is determined, this swing weight may need to be adjusted to a new swing weight that would represent a golf club shaft 304 with a length of the standard 45 inch shaft. In order to do so, 6 swing weight points may generally be added to the original swing weight for each inch of difference the golf club shaft 304 is from 45 inches.

After the length of the golf club shaft 304 is normalized by adjusting for the swing weight, this adjusted swing weight of the club also needs to also be normalized. In order to normalize the swing weight of the golf club shaft 304, the frequency of the golf club shaft 304 as obtained via the steps described above is adjusted −1 cpm per 1 swing weight difference from the default swing weight of C8. Once the frequency of the golf club shaft 304 is adjusted for the length and swing weight, the new normalized butt frequency of the golf club shaft 304 may correspond with the "butt frequency" as used in Table 1 above.

Figure 4:
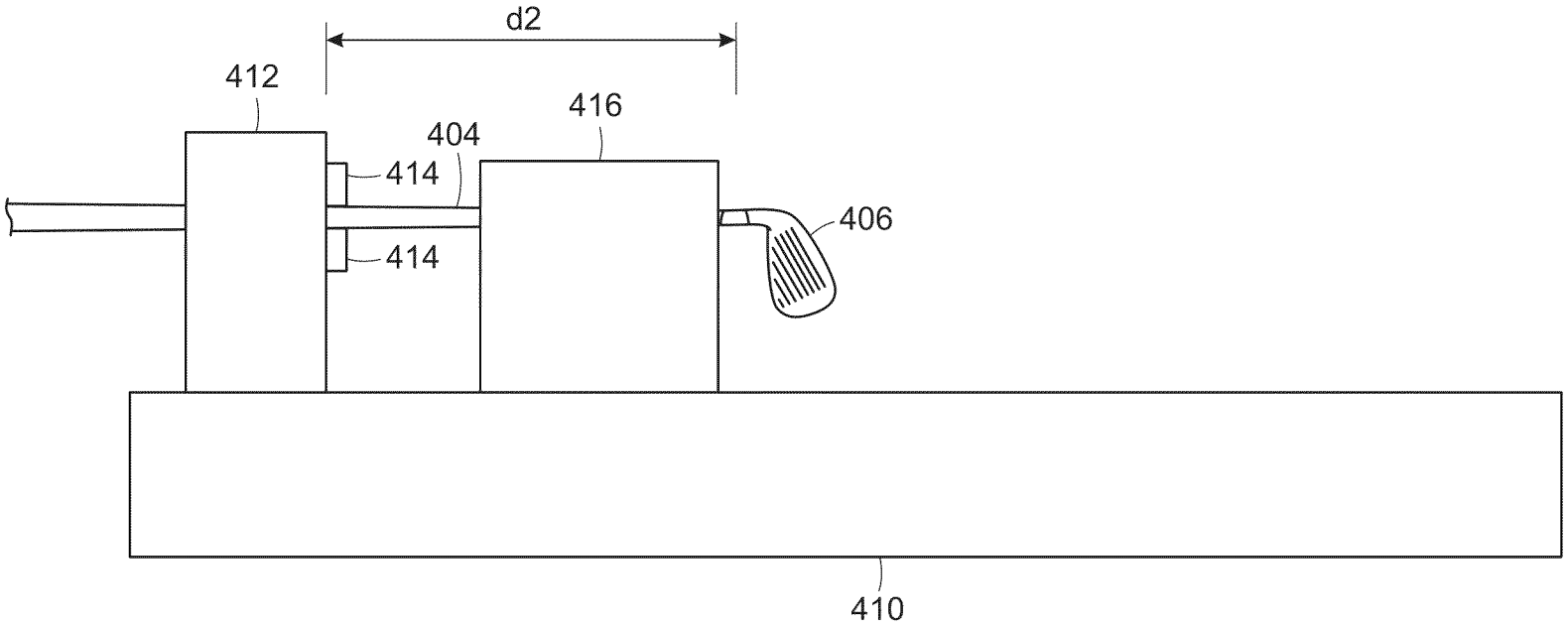
FIG. 4 is a side view of a measurement device used for measuring the frequency of a golf club shaft near the tip end in accordance with an exemplary embodiment of the present invention.

Once the normalized butt frequency is determined, it may be important to determine the tip frequency of the golf club shaft 304. FIG. 4 illustrates the set-up of the frequency measuring device 416 in accordance with an alternative embodiment of the present invention for determining the tip frequency of a golf club shaft 404. The first step in determining the tip frequency of a golf club shaft 404 is to clamp down more of the golf club shaft 404 by shortening the length of the golf club shaft 404 that is available for oscillation. More specifically, the golf club shaft 404 may be clamped down at a distance d2 away from the tip end of the golf club shaft 404, with the distance d2 most preferably at about 12⅝ inches away from the tip end of the golf club shaft. With the golf club shaft 404 secured using a chuck 414 at a distance d2 of 12⅝ inches away from the tip, the golf club head 406 is connected to the tip end of the golf club shaft 404 to provide sufficient weight to promote proper oscillation.

Because the distance d2 of the golf club shaft 404 available for oscillation is so short, it becomes difficult to engage the golf club head 406 with the base 410 of the measurement apparatus. Thus, in order to generate an accurate reading, the golf club shaft 404 is deflected approximately 1 inch from its resting position in order to generate sufficient movement for oscillating the golf club shaft 404. However, similar to the un-normalized butt frequency above, the result of this tip frequency is also un-normalized. In order to normalize this raw tip frequency, it may be necessary to determine the frequency ratio. This frequency ratio is determined by Equation 3 below:

$$\text{Frequency Ratio} = \frac{\text{Un-Normalized Tip Frequency}}{\text{Un-Normalized Butt Frequency}} \qquad \text{Eq. (3)}$$

Once the frequency ratio is determined, the normalized tip frequency can be calculated by multiplying the normalized butt frequency by the frequency ratio. The end result of the normalized tip frequency may generally be correspond with the "tip frequency" as referred to in Table 1.

Figure 5:
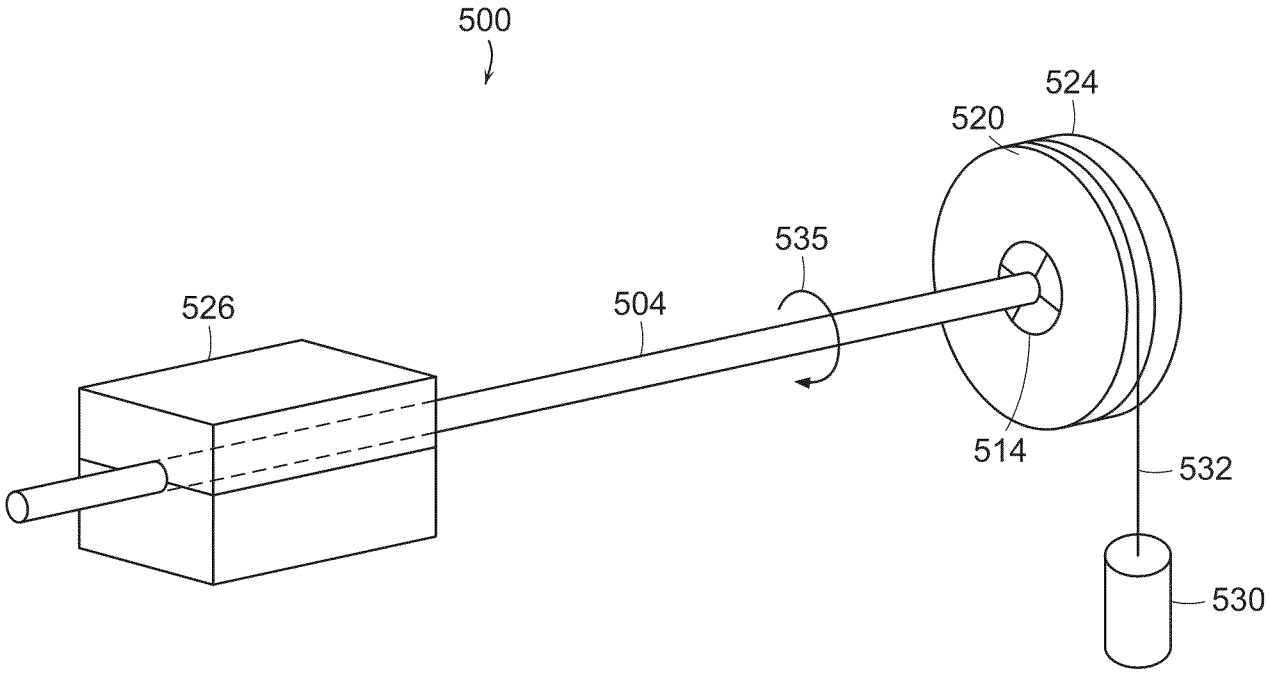
FIG. 5 is a perspective view of a measurement device used for measuring the torque of a golf club shaft in accordance with an exemplary embodiment of the present invention.

As we can see from Table 1, other than tip frequency and butt frequency, the torque of the golf club shaft also serves as another important factor in determining the performance criteria of a plurality of golf club shafts within the matrix. FIG. 5 shows a perspective view of a torque tester apparatus 500 in accordance with an exemplary embodiment of the present invention. This torque tester apparatus 500, or something capable of achieving the same goals and objectives, may generally be known as a shaft torque tester. In theory, this torque tester apparatus 500 may generally involve a clamping apparatus 526 that is capable of securing the golf club shaft 504 at one end of the golf club shaft 504. The other end of the golf club shaft 504 may generally be connected to a weight 530 via a string 532 that is suspended over one of the plurality of plates 520, and 524. Within this exemplary embodiment shown in FIG. 5, the first plate 520 may be connected to the weight 530 via a string 532, while the second plate 524 may be stationary, allowing the golf club shaft 504 to twist in a direction indicated by the arrow 535 due to the weight causing the plate 520 to turn. The weight 530, as shown in this current exemplary embodiment may generally be about 940 grams.

Figure 6:
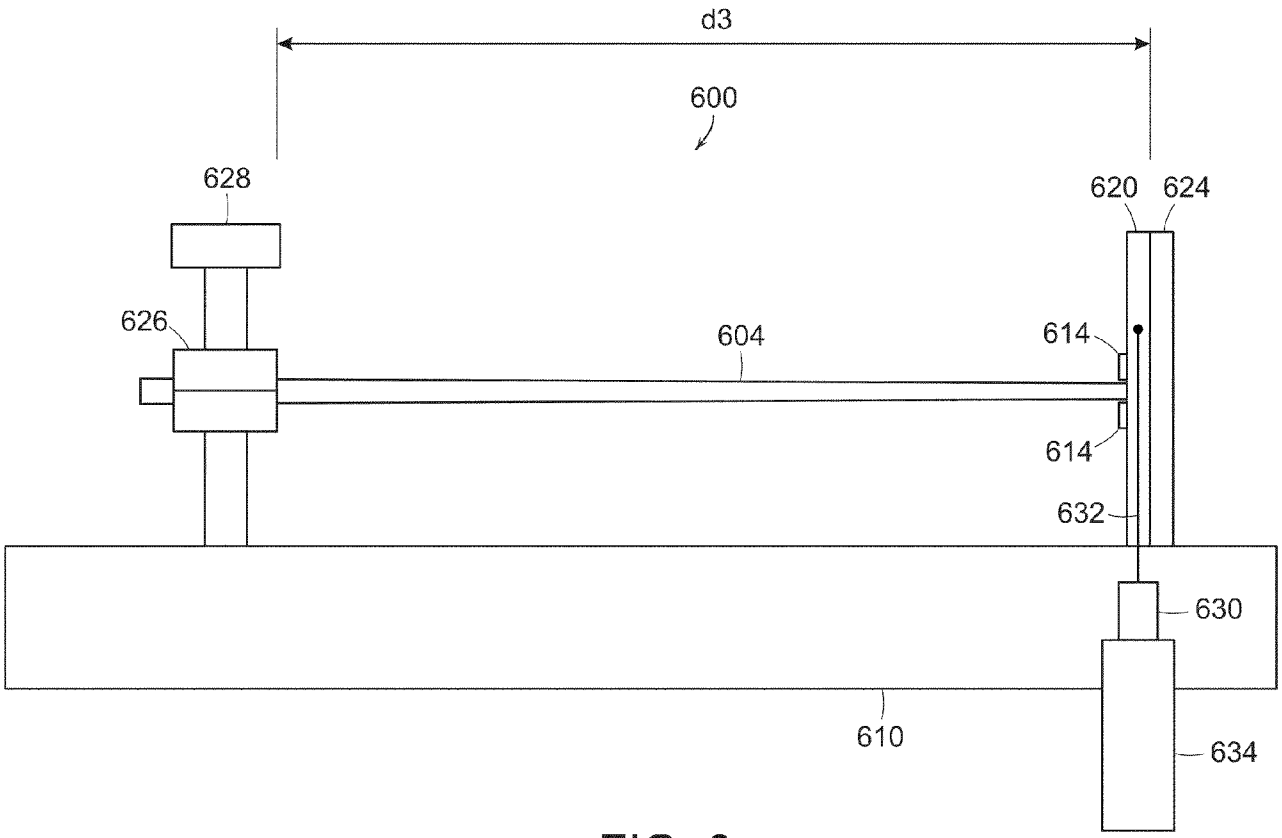
FIG. 6 is a side view of a golf club shaft secured within a measurement device used for measuring the torque of a golf club shaft in accordance with an exemplary embodiment of the present invention.
Figure 7:
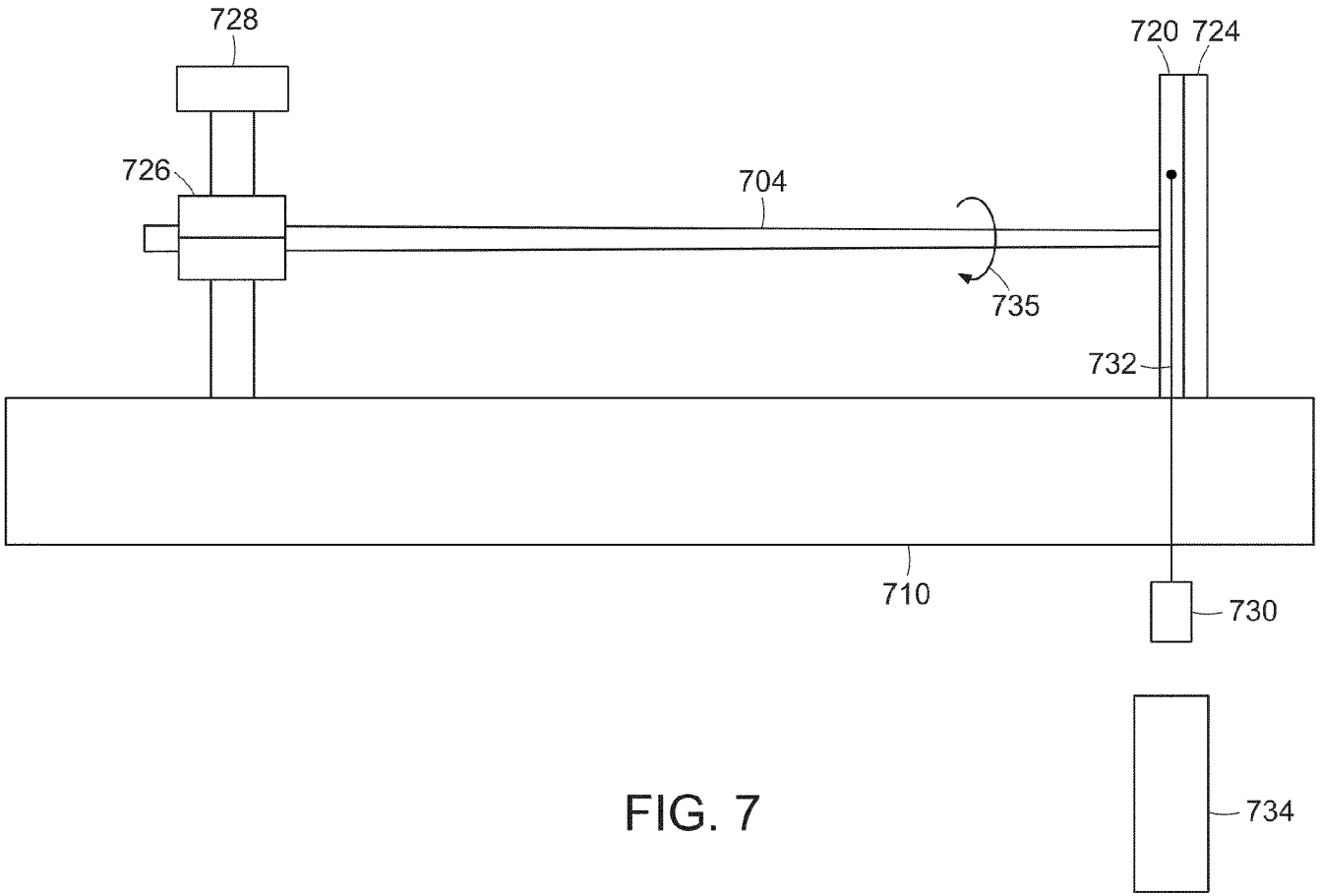
FIG. 7 is a side view of a golf club shaft under a load used for measuring the torque of a golf club shaft in accordance with an exemplary embodiment of the present invention.

FIGS. 6 and 7 gives a better illustration of the determination of the torque of a golf club shaft 504 by illustrating how the weight 530 creates a twisting force upon the golf club shaft 504. Turning now to FIG. 6, we can see a side view of the apparatus 600 for measuring the torque of a golf club shaft 604 in accordance with an exemplary embodiment of the present invention. The first step in determining the torque of a golf club shaft 604 is to insert the golf club shaft 604 into the testing apparatus 600, ensuring that the distance d3 is about 38 inches for a driver type golf club shaft 604; while maintaining the insertion distance into the plurality of plates 620 and 624 by the chuck 614 to be about 1 inch. It is important to note here that the butt end of the golf club shaft 604 may generally be fitted into the clamping apparatus 626 side of the testing apparatus 600 while the tip of the golf club shaft 604 is inserted into the plurality of plates 620 and 624.

Once the golf club shaft 604 is secured into the apparatus 600 by tightening the chuck 614, the clamping device 626 at the butt end of golf club shaft 604 clamps down to ensure the golf club shaft 604 is tightly secured on both ends. After both ends of the golf club shaft 604 are secured, the support member 634 will be removed, allowing the weight 630 to twist the first plate 620; creating a torsional force onto the golf club shaft 604.

FIG. 7 gives a better illustration of the torsional force applied by the weight 730 once the support member 734 is removed, allowing the weight 730 to suspend and turn the plate 720 from which it is attached to. As it can be seen from FIG. 7, once the weight 730 is released from the support member 734, the first plate 720 will rotate in a clockwise direction as indicated by arrow 735. This rotational twisting of the first plate 720 will cause the shaft 704 to twist, allowing the torque of the golf club shaft 704 to be measured at the clamping device 726 end. The amount of twisting of the shaft may generally relate to the torque of the golf club shaft 704.

Other than in the operating example, or unless otherwise expressly specified, all of the numerical ranges, amounts, values and percentages such as those for amounts of materials, moment of inertias, center of gravity locations, loft, draft angles, various performance ratios, and others in the foregoing portions of the specification may be read as if prefaced by the word "about" even though the term "about" may not expressly appear in the value, amount, or range. Accordingly, unless indicated to the contrary, the numerical parameters set forth in the following specification and attached claims are approximations that may vary depending upon the desirable properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A plurality of two or more shafts for a golf club comprising:

a first shaft having a substantially tubular shape and having a first shaft weight, a first shaft flex, a first shaft torque, a first tip frequency, and a first butt frequency; and a second shaft having a substantially tubular shape and having a second shaft weight, a second shaft flex, a second shaft torque, a second tip frequency, and a second butt frequency, wherein a weight of said first shaft and a weight of said second shaft are less than 2 grams apart;

wherein a difference in weight-to-torque ratio between said first shaft and said second shaft is greater than 2.0;

wherein said weight-to-torque ratio is determined by dividing said shaft weight by said shaft torque, and wherein said first butt frequency and said second butt frequency are both between about 240 cpm and about 280 cpm.

2. The plurality of two or more shafts for a golf club of claim 1, wherein said first tip frequency and said second tip frequency are both between about 750 cpm and about 930 cpm.

3. The plurality of two or more shafts for a golf club of claim 2, wherein said first shaft and said second shaft has substantially identical graphics.

* * * * *